US008690596B2

(12) United States Patent
Su et al.

(10) Patent No.: US 8,690,596 B2
(45) Date of Patent: Apr. 8, 2014

(54) JACK CONNECTOR

(75) Inventors: Yu Sheng Su, Taipei (TW); James R. Kirk, Taipei (TW)

(73) Assignees: Tyco Electronics Holdings (Bermuda) No. 7 Ltd., Pembroke (BM); Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/487,551

(22) Filed: Jun. 4, 2012

(65) Prior Publication Data

US 2012/0309220 A1 Dec. 6, 2012

(30) Foreign Application Priority Data

Jun. 3, 2011 (CN) ..... 2011 1 0154227

(51) Int. Cl.
*H01R 13/627* (2006.01)

(52) U.S. Cl.
USPC ..... 439/354

(58) Field of Classification Search
USPC ..... 439/676, 541.5, 353, 344, 354
See application file for complete search history.

(56) References Cited

U.S. PATENT DOCUMENTS

2006/0148301 A1* 7/2006 Kim ..... 439/354

OTHER PUBLICATIONS

Drawing, TE Connectivity, Name: IXI Mag45 (TM), Modular Jack, 4G62 Gigabit Circuit, With ESD Protection, Shielded, With Leds, Drawing No. C-1840437, 2 pages.

* cited by examiner

*Primary Examiner* — Neil Abrams
*Assistant Examiner* — Phuongchi T Nguyen
(74) *Attorney, Agent, or Firm* — Barley Snyder

(57) ABSTRACT

A jack connector includes a main body, contact terminals, and an engaging assembly. The main body has a lateral opening on its one side surface and a top opening on a top surface connected to the side surface. A portion of the contact terminals are provided in the main body. The engaging assembly is mounted on the top surface of the main body to surround the top opening. The engaging assembly has two engaging plates protruding from the top opening. When a plug is inserted into the jack connector via the lateral opening, the two engaging plates of the jack connector are engaged with the plug, so that the plug can be electrically connected to the jack connector via the contact terminals.

7 Claims, 17 Drawing Sheets

JACK CONNECTOR

CROSS-REFERENCE TO RELATED APPLICATIONS

This application claims the benefit of the filing date under 35 U.S.C. §119(a)-(d) of Chinese Patent Application No. 201110154227.8, filed Jun. 3, 2011.

FIELD OF THE INVENTION

The present invention relates to a jack connector, and in particular to a RJ-45 jack connector.

BACKGROUND

Please refer to FIGS. 1A, 1B and 1C, which are schematic views showing the insertion of a plug into a conventional RJ-45 jack connector respectively. FIG. 1A is a schematic view showing a state before a conventional RJ-45 jack receives a plug. FIG. 1B is a schematic view showing the conventional RJ-45 jack connector mated with the plug. FIG. 1C is a cross-sectional view showing the conventional RJ-45 jack connector mated with the plug.

First, the respective parts of the conventional jack connector will be described with reference to FIG. 1A. As shown in FIG. 1A, a plug 11 and a jack connector 12 are provided. The top surface of the plug 11 is provided with an engaging piece 111. Left and right sides of the engaging pieces 111 are provided with an engaging wall 112 respectively. The jack connector 12 is provided with a main body 121. A surface of the main body 121 is provided with a shroud 122. The inside surfaces of the shroud 122 are provided with two engaging plates 123 as shown in FIG. 1C. These two engaging plates 123 are configured to be engaged with the engaging walls 112 formed on left and right sides of the top surface of the plug 11 when the plug 11 is inserted into the jack connector 12.

The insertion of a conventional plug into a conventional jack connector will be described later with reference to FIGS. 1A and 1B. As shown in FIG. 1A, when the plug 11 is to be inserted into the jack connector 12, a user has to align the engaging piece 111 of the plug 11 with the shroud 122 of the jack connector 12, so that the plug 11 can be correctly inserted into the jack connector 12. After the plug 11 is inserted into the jack connector 12, the two engaging plates 123 provided on the shroud 122 of the jack connector 12 can be engaged with the engaging walls 112 on left and right sides of the top surface of the plug 11. In this way, the plug 11 can be fixedly inserted into the jack connector 12.

Referring to FIG. 1C, which is a cross-sectional view showing the conventional RJ-45 jack mated with the plug. As shown in FIG. 1C, the two engaging plates 123 provided on the shroud 122 of the jack connector 12 are engaged with the engaging walls 112 on left and right sides of the top surface of the plug 11, so that the plug 11 can be fixedly inserted to the jack connector 12.

Referring to FIGS. 1D and 1E, which are schematic views showing the structure of the conventional RJ-45 jack connector. The problems occurring when the plug is inserted into the conventional RJ-45 jack connector will be described.

As shown in FIG. 1D, the two engaging plates 123 provided on the shroud 122 of the jack connector 12 are engaged with the engaging walls 112 on left and right sides of the top surface of the plug 11, so that the plug 11 can be fixedly inserted into the jack connector 12. Since the engaging portion is located on an upper surface of the shroud 122 and the dimension of the shroud 122 is restricted by the dimension of the main body 121, as shown in FIG. 1E, the dimension of the portion of the shroud 122 comprising the engaging plates 123 cannot be reduced further, which does not conform to the modern requirements for compact design of hardware in this field. As shown in FIG. 1E, the height of an upper portion of the shroud 122 in such a conventional RJ-45 jack connector is hardly smaller than 3.55 mm.

In view of the above, it is an important issue for the manufacturers in this field to propose a novel RJ-45 jack connector, which is capable of reducing its dimension and allowing a plug to insert therein.

SUMMARY

In view of the above problems, an object of the invention, among other objects, is to provide a jack connector, including: a main body, a plurality of contact terminals, and an engaging assembly. The main body has a lateral opening on its one side surface and a top opening on a top surface connected to the side surface. The plurality of contact terminals are partially provided in the main body. The engaging assembly is mounted on the top surface of the main body to surround the top opening. The engaging assembly has two engaging plates protruding from the top opening. When a plug is inserted into the jack connector via the lateral opening, the two engaging plates of the jack connector are engaged with the plug, so that the plug can be electrically connected to the jack connector via the contact terminals.

BRIEF DESCRIPTION OF THE DRAWINGS

The invention is described in more detail with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Figure 1A:
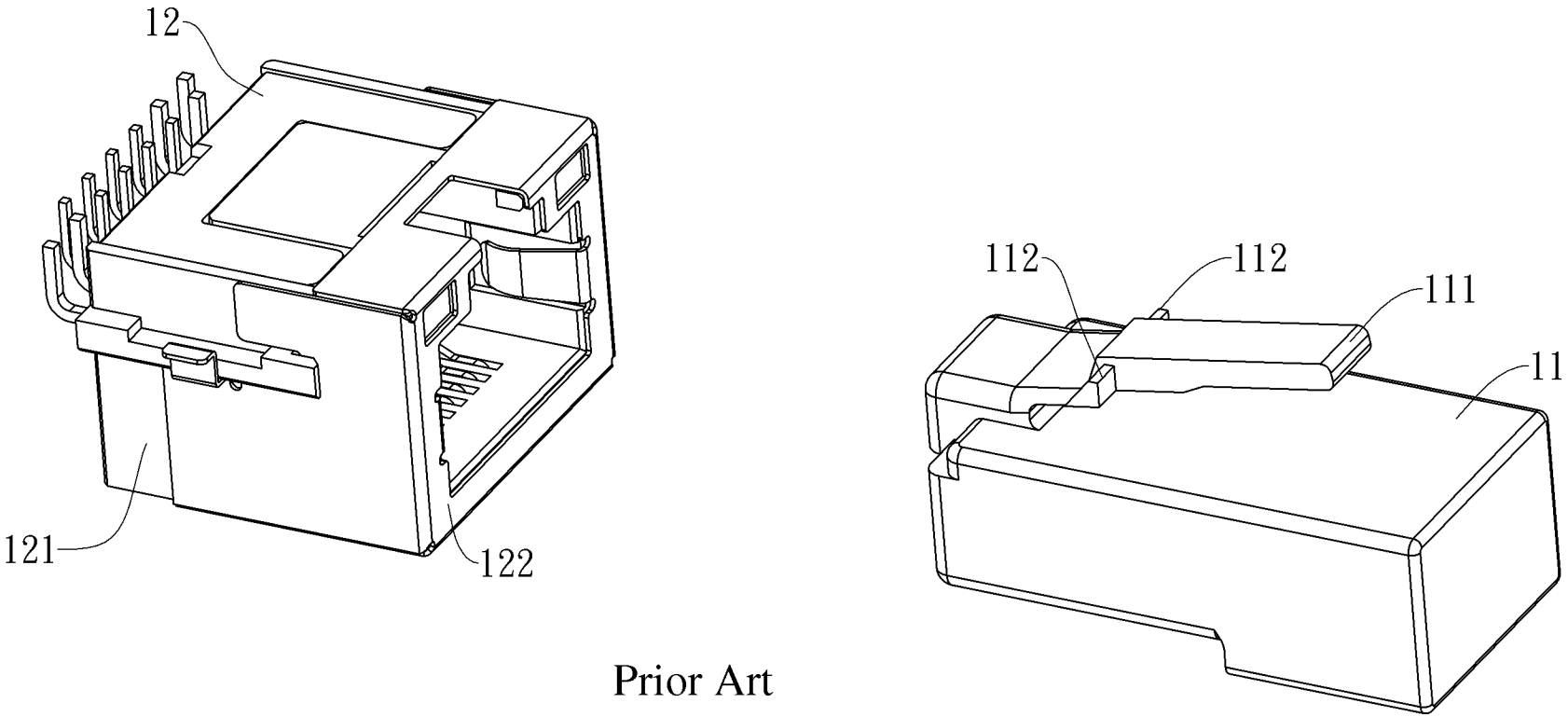
Prior Art Fig. 1A
FIG. 1A is a schematic view showing a state before a conventional RJ-45 jack connector is mated with a plug.
Figure 1B:
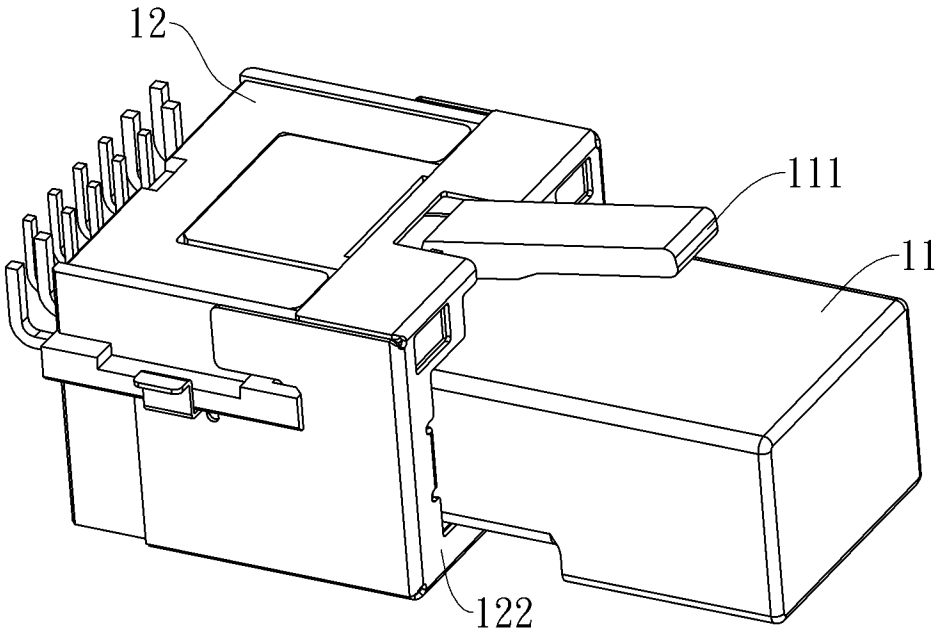
Prior Art Fig. 1B
FIG. 1B is a schematic view showing a state after the conventional RJ-45 jack connector is mated with the plug.
Figure 1C:
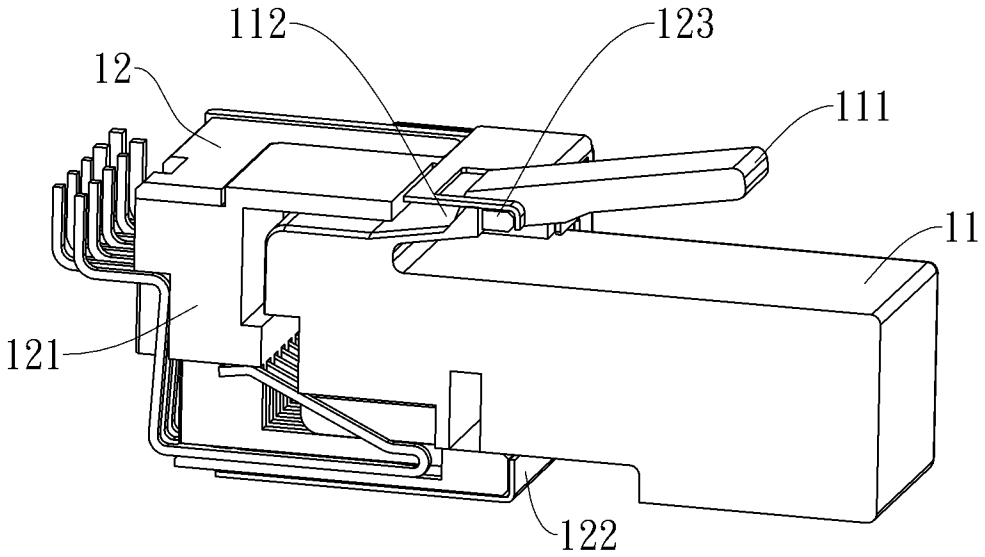
Prior Art Fig. 1C
FIG. 1C is a cross-sectional view showing a state after the conventional RJ-45 jack connector is mated with the plug.
Figure 1D:
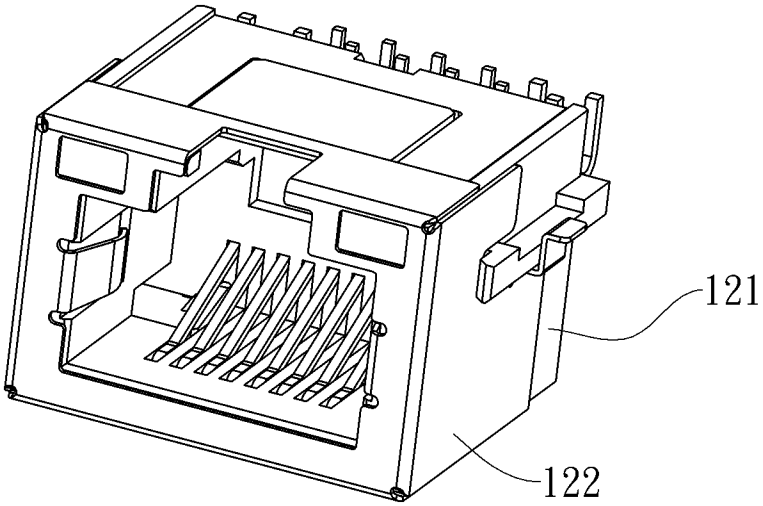
Prior Art Fig. 1D
FIG. 1D is a side view of the conventional RJ-45 jack connector.
Figure 1E:
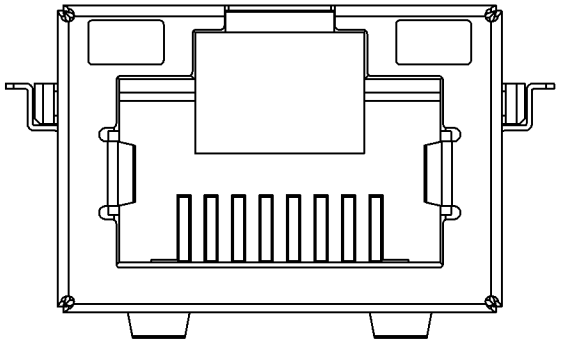
Prior Art Fig. 1E
FIG. 1E is a rear view of the conventional RJ-45 jack connector.
Figure 2A:
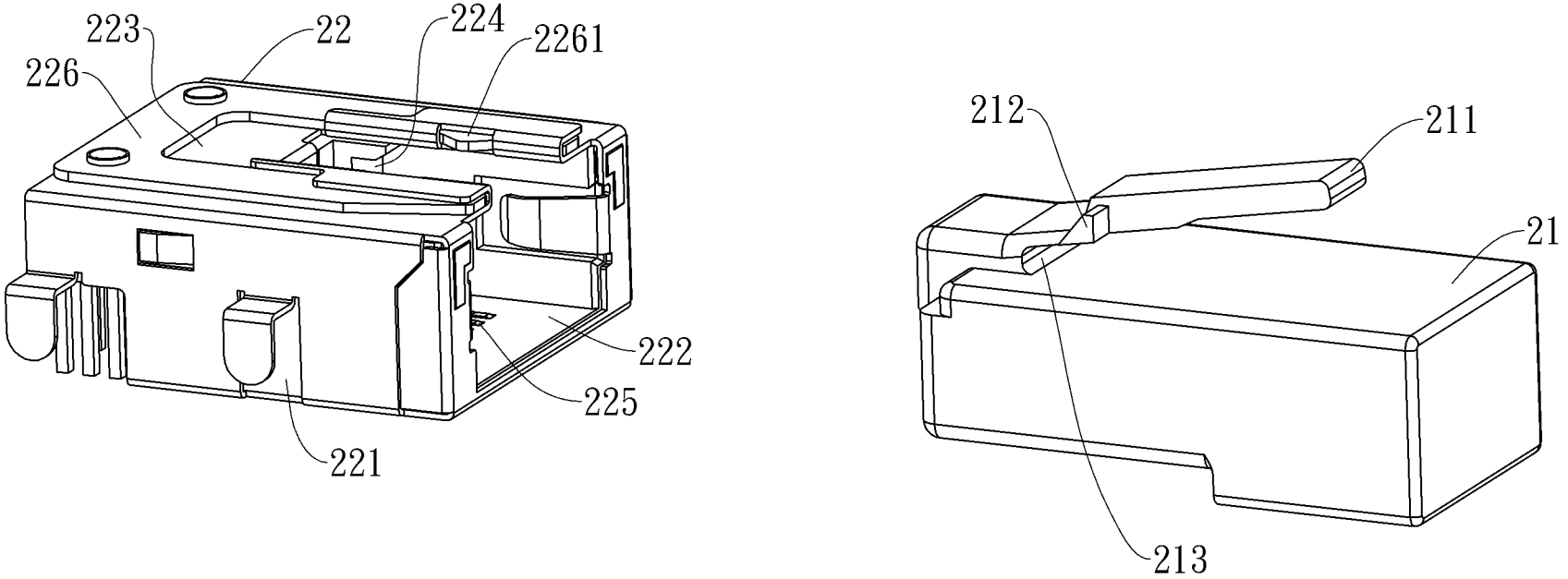
FIG. 2A is a schematic view showing a state before a plug is mated with the jack connector.

First, the respective parts of the jack connector of the invention will be described with reference to FIG. 2A. As shown in FIG. 2A, the jack connector for a plug 21 has a connector portion 22. The top surface of the plug 21 is provided with an engaging piece 211. Left and right sides of the engaging piece 211 are provided with an engaging wall 212 respectively. One side surface of the main body 221 of the connector portion 22 has a lateral opening 222. A top surface 223 connected to the side surface having the lateral opening 222 is provided with a top opening 224. A portion of contact terminals 225 are provided in the main body 221 and electrically connected with the plug 21.

The top surface 223 of the main body 221 is provided with an engaging assembly 226. The engaging assembly 226 has two engaging plates 2261 protruding from the top opening 224. When the plug 21 is inserted into the connector portion 22 via the lateral opening 222, the two engaging plates 2261 of the connector portion 22 are engaged with the plug 21, so that the plug 21 can be electrically connected to the connector portion 22 via the contact terminals 225.

Figure 2B:
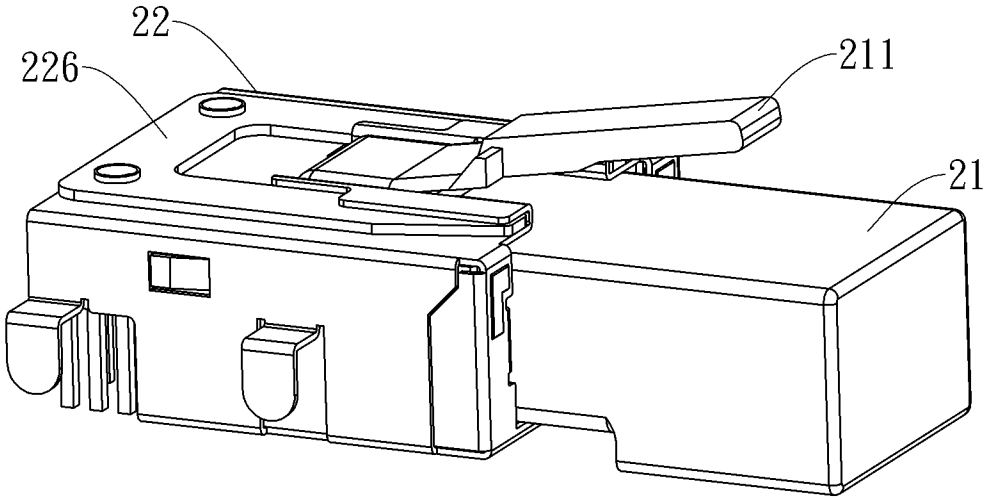
FIG. 2B is a schematic view showing a state after the plug mated with the jack connector.

Next, the insertion of the plug 21 into the connector portion 22 of the invention will be described by reference to FIGS. 2A and 2B. As shown in FIG. 2A, when the plug 21 is to be inserted into the connector portion 22, the user has to align the engaging piece 211 of the plug 21 with an insertion port of the connector portion 22, so that the plug 21 can be inserted into the connector portion 22. When the plug 21 is inserted into the connector portion 22 with a sufficient depth, the two engaging plates 2261 of the engaging assembly 226 of the connector portion 22 are engaged with two vertical walls 213. The two vertical walls 213 are connected to the two engaging walls 212 on left and right sides of the top surface of the plug 21. In this way, the plug 21 can be mated with the connector portion 22.

Figure 2C:
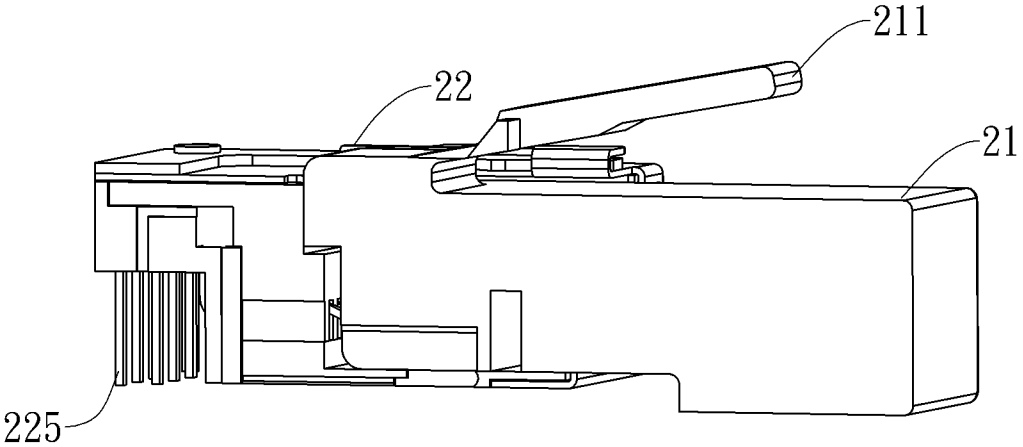
FIG. 2C is a cross-sectional view showing a state after the plug is mated with the jack connector.

As shown in FIG. 2C, the two engaging plates 2261 of the engaging assembly 226 of the connector portion 22 are engaged with the vertical walls 213. The two vertical walls 213 are connected to the engaging walls 212 on the left and right sides of the top surface of the plug 21. In this way, the plug 21 can be fixed to the connector portion 22 and electrically connected to the connector portion 22 via the contact terminals 225.

Figure 2D:
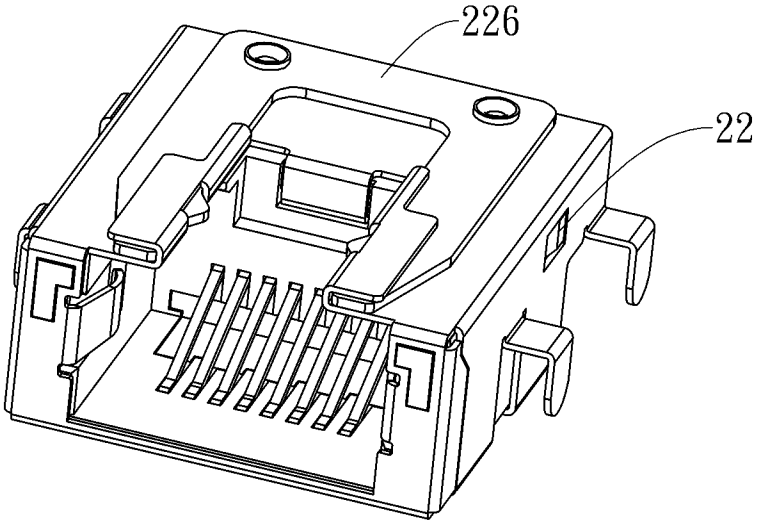
FIG. 2D is a side view of the jack connector of the invention.
Figure 2E:
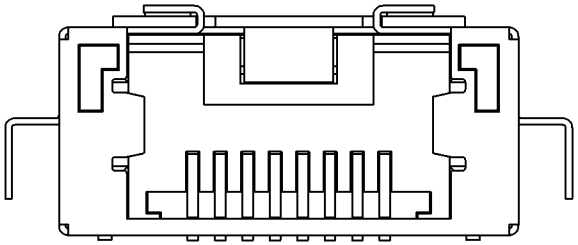
FIG. 2E is a rear view of the jack connector of the invention.

As shown in FIG. 2D, the two engaging plates 2261 of the engaging assembly 226 of the connector portion 22 are engaged with the vertical walls 213 connected to the engaging walls 212 on left and right sides of the top surface of the plug 21. In this way, the plug 21 can be fixed to the connector portion 22 and electrically connected to the connector portion 22 via the contact terminals 225. Since the thickness of the engaging assembly 226 engages the plug 21 and the connector portion 22, as shown in FIG. 2E, the dimension of the connector portion 22 is reduced further, which conforms to the requirements for compact design of hardware in this field. As shown in FIG. 2E, the height of an upper side of the RJ-45 jack connector of the present invention may be reduced to 1.7 mm.

Figure 3A:
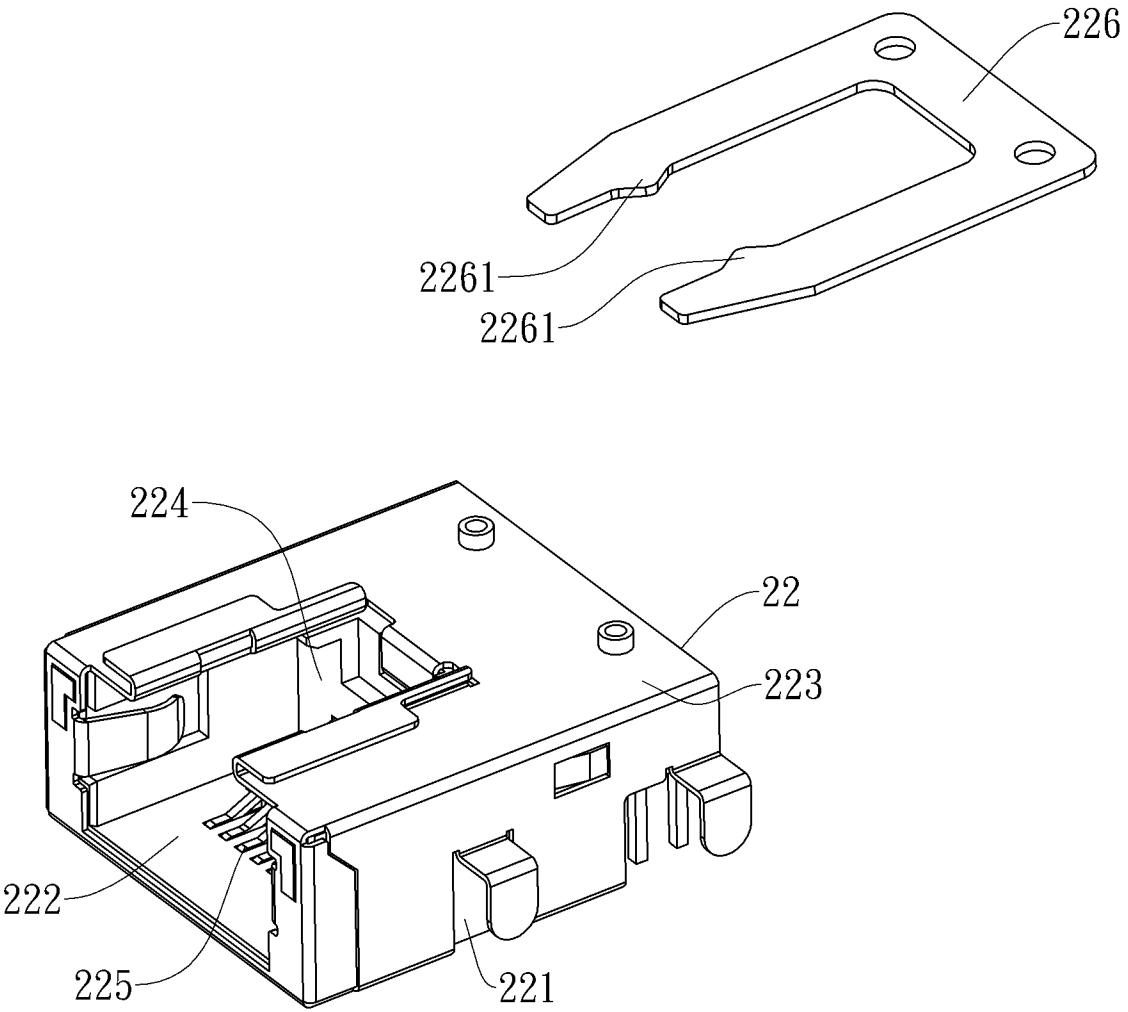
FIGS. 3A through 3D are schematic views showing the assembly of the jack connector of the present invention.

As shown in FIG. 3A, one side surface of the main body 221 of the connector portion 22 is provided with a lateral opening 222. A top surface 223 connected to the side surface having the lateral opening 222 is provided with a top opening 224. A portion of the contact terminals 225 are provided in the main body 221. The engaging assembly 226 has two engaging plates 2261.

Figure 3B:
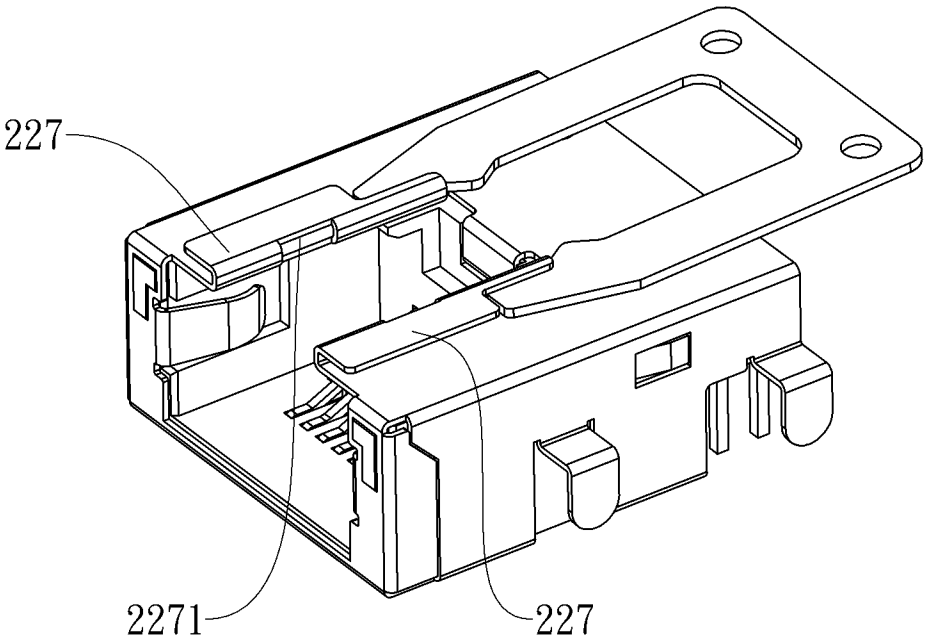
Figure 3C:
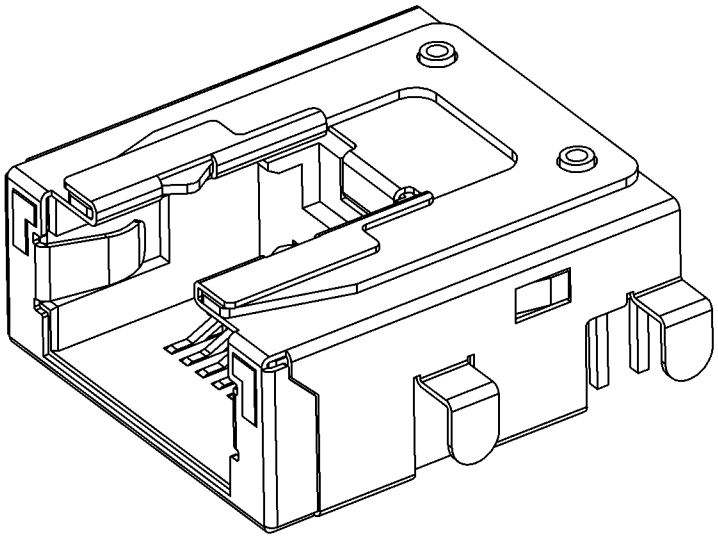

When the engaging assembly 226 is to be mounted on the top surface 223 of the main body 221, as shown in FIG. 3B, the engaging assembly 226 slides along flanges 227 on both sides of the top opening 224. Thus, as shown in FIG. 3C, the two engaging plates 2261 of the engaging assembly 226 finally protrude from openings 2271 of the flanges 227 respectively.

Figure 3D:
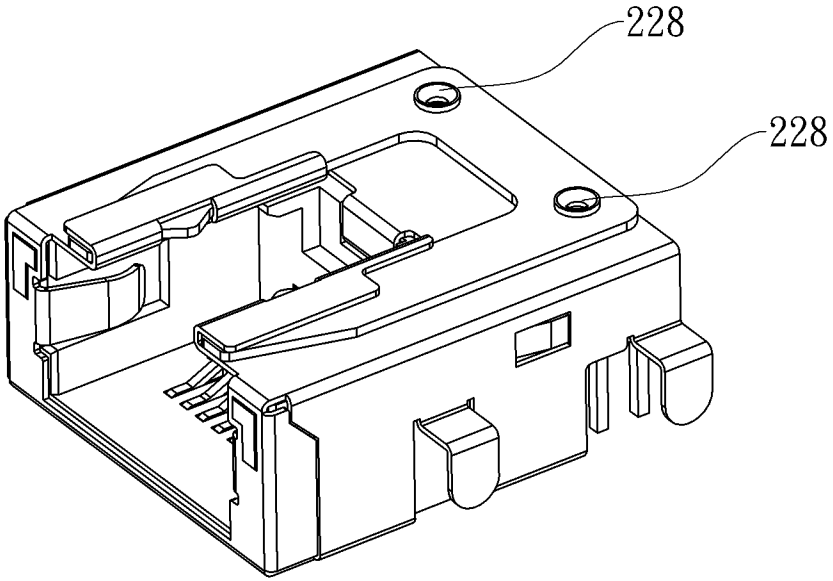

Finally, as shown in FIG. 3D, the engaging assembly 226 is riveted (see 228) to the top surface 223 of the main body 221.

Figure 4:
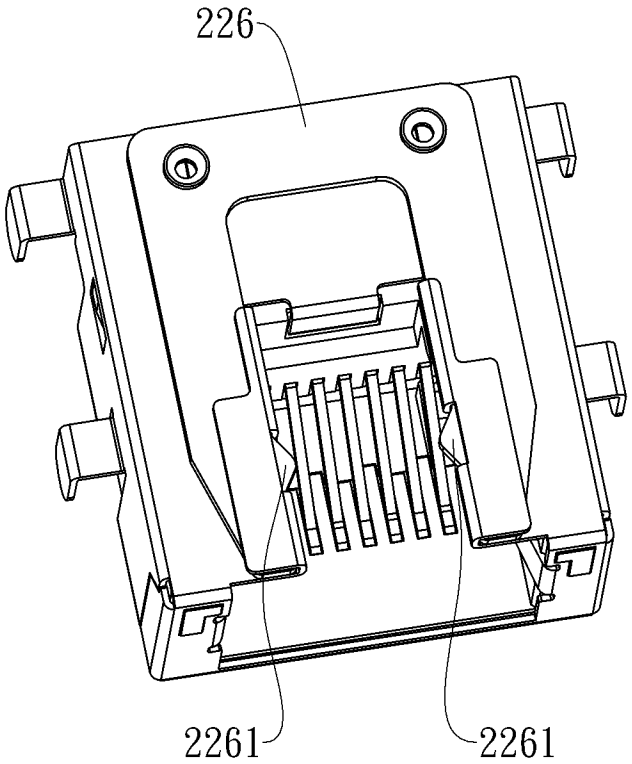
FIG. 4 is a top view of the jack connector of the invention.

As shown in FIG. 4, the engaging assembly 226 is substantially formed into an inverted U shape, and the two engaging plates 2261 are provided near two free ends of the inverted U-shaped engaging assembly 226. Further, the two engaging plates 2261 protruding from the top opening 224 are shaped to allow a plug to be inserted into the jack connector via the lateral opening 222.

Figure 5A:
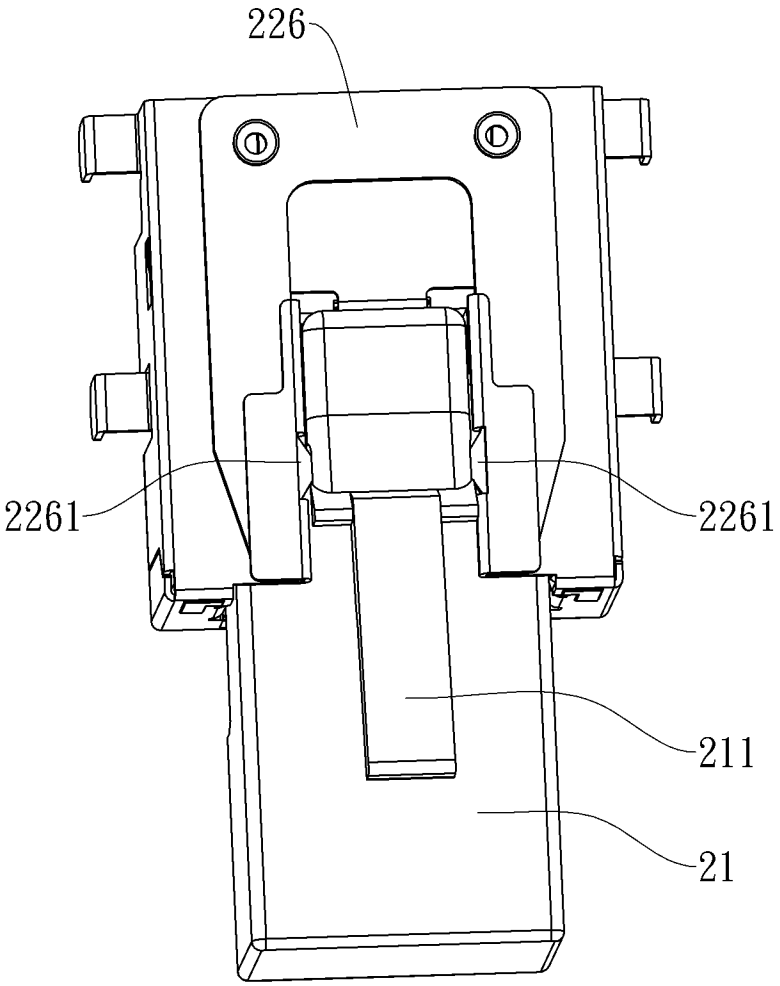
FIG. 5A is a top view showing the connection of the jack connector of the invention.
Figure 5B:
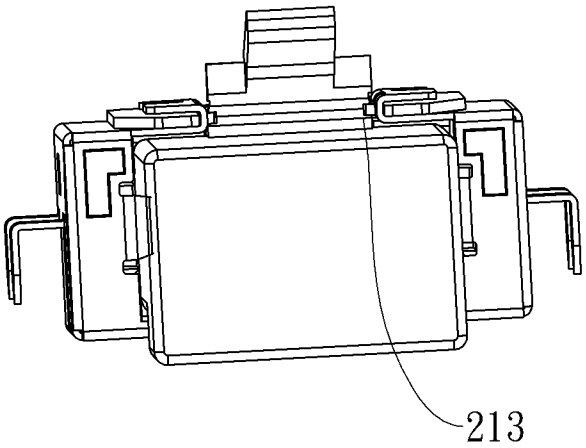
FIG. 5B is a side view showing the connection of the jack connector of the invention.

As shown in FIG. 5A and FIG. 5B the drawings, when the plug 21 is inserted into the jack connector of the present invention via the lateral opening, the two engaging plates 2261 of the engaging assembly 226 are engaged with the vertical walls 213 of the two engaging walls 212 of the plug 21 respectively.

According to the above, the RJ-45 jack connector of the present invention has a simple structure, reduces its dimension, and conforms to the requirements for compact design of modern connectors in this field.

What is claimed is:

1. A jack connector, comprising:

a main body having a lateral opening on a side surface and a top opening on a top surface connected to the side surface;

a plurality of contact terminals partially provided in the main body; and an engaging assembly mounted on the top surface of the main body to surround the top opening, the engaging assembly having two engaging plates protruding from the top opening, wherein when a plug is inserted into the jack connector via the lateral opening, the two engaging plates of the jack connector are engaged with a vertical wall of an engaging piece of the plug, so that the plug is electrically connected to the jack connector via the contact terminals.

2. The jack connector according to claim 1, wherein the jack connector is a RJ-45 jack connector.

3. The jack connector according to claim 1, wherein the engaging assembly is substantially formed into an inverted U shape, and the two engaging plates are provided near two free ends of the inverted U-shaped engaging assembly respectively.

4. The jack connector according to claim 1, wherein the two engaging plates protruding from the top opening are shaped to allow the plug to be inserted into the jack connector via the lateral opening.

5. The jack connector according to claim 1, wherein a top surface of the plug is provided with the engaging piece, and the top opening of the main body is configured to receive the engaging piece when the plug is inserted into the jack connector via the lateral opening.

6. The jack connector according to claim 1, wherein the two engaging plates of the engaging assembly protrude from openings of flanges provided on both sides of the top opening.

7. A jack connector, comprising:

a main body having a lateral opening on a side surface and a top opening on a top surface connected to the side surface;

a plurality of contact terminals partially provided in the main body; and an engaging assembly mounted on the top surface of the main body to surround the top opening, the engaging assembly having two engaging plates protruding from the top opening, wherein when a plug is inserted into the jack connector via the lateral opening, the two engaging plates of the jack connector are engaged with a vertical wall positioned at the base of an engaging piece of the plug, so that the plug is electrically connected to the jack connector via the contact terminals.

* * * * *